US008628065B2

(12) United States Patent
Reid

(10) Patent No.: US 8,628,065 B2
(45) Date of Patent: Jan. 14, 2014

(54) ELECTRIC FENCE CONVERTER

(76) Inventor: Leland Reid, Spring Grove, IL (US)

( * ) Notice: Subject to any disclaimer, the term of this patent is extended or adjusted under 35 U.S.C. 154(b) by 315 days.

(21) Appl. No.: 13/159,716

(22) Filed: Jun. 14, 2011

(65) Prior Publication Data

US 2011/0303436 A1 Dec. 15, 2011

Related U.S. Application Data

(60) Provisional application No. 61/397,493, filed on Jun. 14, 2010.

(51) Int. Cl.
*A01K 3/00* (2006.01)

(52) U.S. Cl.
USPC ..... 256/10; 256/52; 174/158 F

(58) Field of Classification Search
USPC ..... 256/10, 47, 48, 52; 174/158 F, 161 F, 174/163 F
See application file for complete search history.

(56) References Cited

U.S. PATENT DOCUMENTS

| | | | | | |
|---|---|---|---|---|---|
| 2,896,011 | A * | 7/1959 | Huseby | 174/163 F |
| 3,524,923 | A * | 8/1970 | Zeeb | 174/163 F |
| 4,520,231 | A * | 5/1985 | Hubbell | 174/158 F |
| 4,623,756 | A * | 11/1986 | Wilson, Jr. | 174/158 F |
| 4,680,428 | A * | 7/1987 | Wilson, Jr. | 174/158 F |
| 5,085,409 | A * | 2/1992 | Teixeira | 256/48 |
| 5,956,875 | A * | 9/1999 | Aughenbaugh | 256/48 |
| 6,330,998 | B1 * | 12/2001 | Roy | 256/19 |
| 7,207,516 | B2 * | 4/2007 | Sheelar | 242/406 |
| 8,113,473 | B2 * | 2/2012 | Bradley | 174/158 F |
| 8,122,659 | B2 * | 2/2012 | Davidson | 256/1 |

* cited by examiner

*Primary Examiner* — Michael P Ferguson
(74) *Attorney, Agent, or Firm* — Justin Lampel

(57) ABSTRACT

A device for converting a standard fence into an electric fence is disclosed. The electric fence converter has a top end which partly covers an existing fence post, already secured into the ground. The bottom end and mid section of the electric fence converter have a cut-out portion exposing a hollow interior of the device wherein the hollow interior at least partly covers the existing fence post, already secured into the ground. A plurality of securing hooks are located on the exterior surface of the electric fence converter. The securing hooks receive and secure an electric wire and connect a first device to a second device therein creating an electric fence out of an existing non-electric fence.

12 Claims, 4 Drawing Sheets

ELECTRIC FENCE CONVERTER

REFERENCE TO RELATED APPLICATIONS

The present application is based on U.S. provisional application No. 61/397,493 filed on Jun. 14, 2010, currently co-pending, the entire contents of which are incorporated by reference. Applicant claims the priority benefit of the 61/397,493 application.

BACKGROUND OF THE INVENTION

A device for converting a standard fence into an electric fence is disclosed. The electric fence converter has a top end which partly covers an existing fence post, already secured into the ground. The bottom end and mid section of the electric fence converter have a cut-out portion exposing a hollow interior of the device wherein the hollow interior at least partly covers the existing fence post, already secured into the ground. A plurality of securing hooks are located on the exterior surface of the electric fence converter. The securing hooks receive and secure an electric wire and connect a first device to a second device therein creating an electric fence out of an existing non-electric fence.

Types of fences have been around since recorded history. The concept of the electric fence was first described in Mark Twain's *A Connecticut Yankee in King Arthur's Court*, in 1889, as a defensive weapon. Electric fences were used to control livestock in the United States in the early 1930s, and electric fencing technology developed in both the United States and New Zealand.

Over the course of American history, attempts have been made to secure wire onto fence posts. For example, U.S. Pat. No. 4,077,611 to Wilson discloses a fence wire mount and insulator device adapted for mounting on a metal fence post of T-shaped cross section in which wire is supported in spaced relationship relative to the fence post by a bracket member which engages the fence post and is shaped to accommodate a variety of configurations and dimensions. The bracket which engages the fence post is provided with a curved offset portion which permits elongation of one portion of the bracket and permits initial easy insertion of the fence post relative to the bracket.

Further, U.S. Pat. No. 3,820,758 to Berg Jr., discloses a device for attaching an electric fence to a t-shaped fence post. The device has a post gripping means having a pair of resilient generally C-shaped portions which extend laterally from the rear wall on the body of the device.

However, these devices for hanging a wire on a fence post or converting a non-electric fence into an electric fence lack the ease, durability and speed associated with the present device. A need, therefore, exists for an improved electric fence converter.

SUMMARY OF THE INVENTION

A device for converting a standard fence into an electric fence is disclosed. The electric fence converter has a top end which partly covers an existing fence post, already secured into the ground. The bottom end and mid section of the electric fence converter have a cut-out portion exposing a hollow interior of the device wherein the hollow interior at least partly covers the existing fence post, already secured into the ground. A plurality of securing hooks are located on the exterior surface of the electric fence converter. The securing hooks receive and secure an electric wire and connect a first device to a second device therein creating an electric fence out of an existing non-electric fence.

An advantage of the present device is to provide an electric fence converter which has a wire securing device which can easily secure an electric wire.

And another advantage of the present device is to provide an electric fence converter which may be quickly installed on existing non-electric fences, already secured into the ground.

Still another advantage of the present device is that the electric fence converter may have a tear-drop shape which may accommodate a standard t-shaped fence post.

Yet another advantage of the present device is to provide an electric fence converter which is inexpensive to produce and install.

Still another advantage of the present device is to provide an electric fence converter which is easily transported and/or stored easily prior to use.

For a more complete understanding of the above listed features and advantages of the present electric fence converter, reference should be made to the following detailed description of the preferred embodiments. Further, additional features and advantages of the invention are described in, and will be apparent from, the detailed description of the preferred embodiments.

DETAILED DESCRIPTION OF THE PREFERRED EMBODIMENTS

Figure 1:
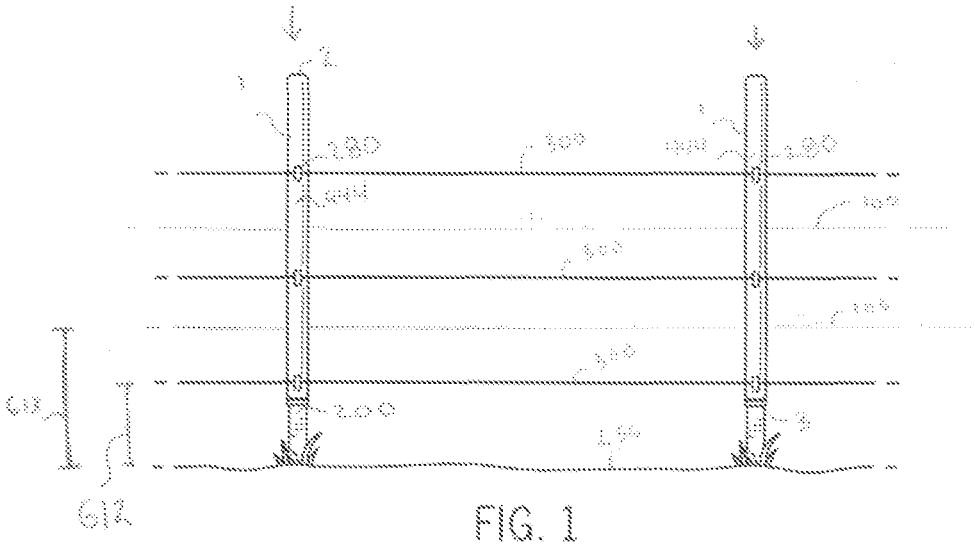
FIG. 1 illustrates a front plan view of the electric fence converter positioned on existing fence posts.

A device for converting a standard fence into an electric fence is disclosed. The electric fence converter has a top end which partly covers an existing fence post, already secured into the ground. The bottom end and mid section of the electric fence converter have a cut-out portion exposing a hollow interior of the device wherein the hollow interior at least partly covers the existing fence post, already secured into the ground. A plurality of securing hooks are located on the exterior surface of the electric fence converter. The securing hooks receive and secure an electric wire and connect a first device to a second device therein creating an electric fence out of an existing non-electric fence.

The device 1 has a closed top side 2, an open bottom side 3, a main body 444 and an interior 4. The device 1 may further have an exterior surface 5 and an inner wall portion 12 (of the interior 4) wherein a fence post 200 may come into contact with during use. Although the device 1 is illustrated in a generally tear-drop shaped manner, it should be noted that the device 1 may be of any suitable shape to achieve its desired function. The device 1 may also have length 10 (FIG. 8) and an exterior perimeter 11. The exterior perimeter 11 may be tear-drop shaped at the top side 2 and may be generally semi-circular at the bottom side 3 and in the middle of the device 1. More specifically, the exterior perimeter 11 may only be complete at the top side 2 of the device 1. The device 1 may be constructed from, for example, metal or plastic. However, it should be noted that the device 1 may be constructed from any suitable material depending on its intended purpose.

Figure 8:
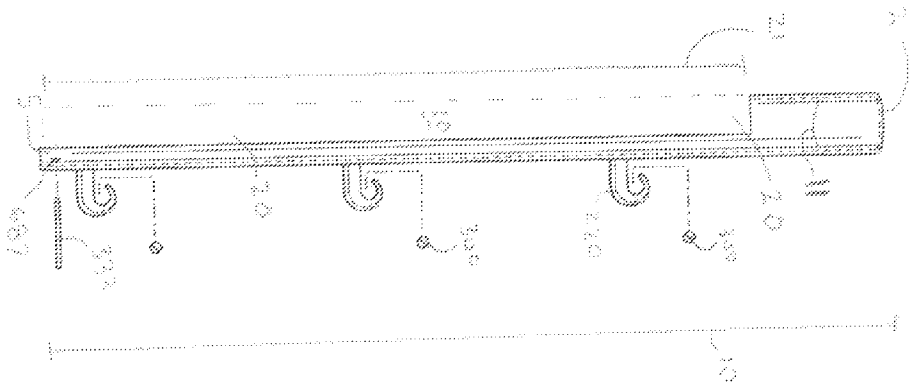
FIG. 8 illustrates a side plan view of the electric fence converter.

Referring to FIG. 8, the device 1 may further have a cut-out portion 20 which may have a length 21 which is approximately seventy to ninety percent of the length 10 of the entire device 1. The cut-out portion 20 may simply be a portion of the device 1 wherein the exterior surface 5 does not extend completely around the exterior perimeter 11 of the entire device 1, but approximately half-way around the exterior perimeter 11 of the device 1 forming a semi-circular arch along most of the length 10 of the device 1. It should be noted that the percentage of the device 1 for which the cut-out portion 20 occupies (both lengthy wise and perimeter wise) may alter dramatically depending on the type of a fence post 200 that the device 1 is being secured upon.

The cut-out portion 20 of the device 1 may extend from the bottom side 3 of the device 1 toward the top side 2 of the device 1, but may not reach the very top of the device 1. More specifically, the cut-out portion 20 of the device 1 may be an opening which runs parallel with respect to the length 10 of the device 1 and runs perpendicular with respect to the top side 2 of the device 1.

Figure 4:
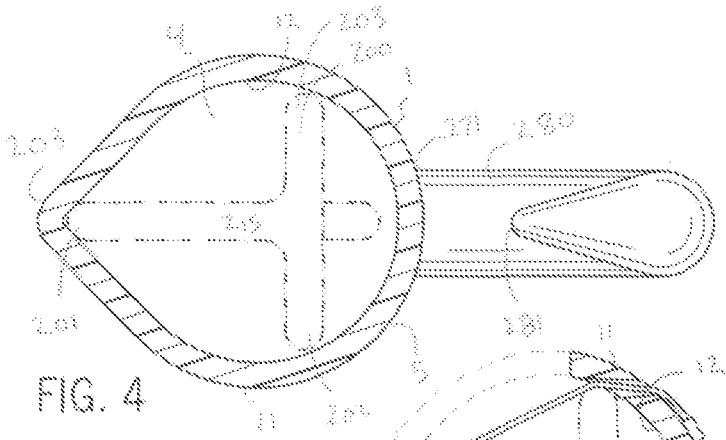
FIG. 4 illustrates a top cross view (Line 4-4) of the electric fence converter inserted over a standard t-shaped fence post.
Figure 2:
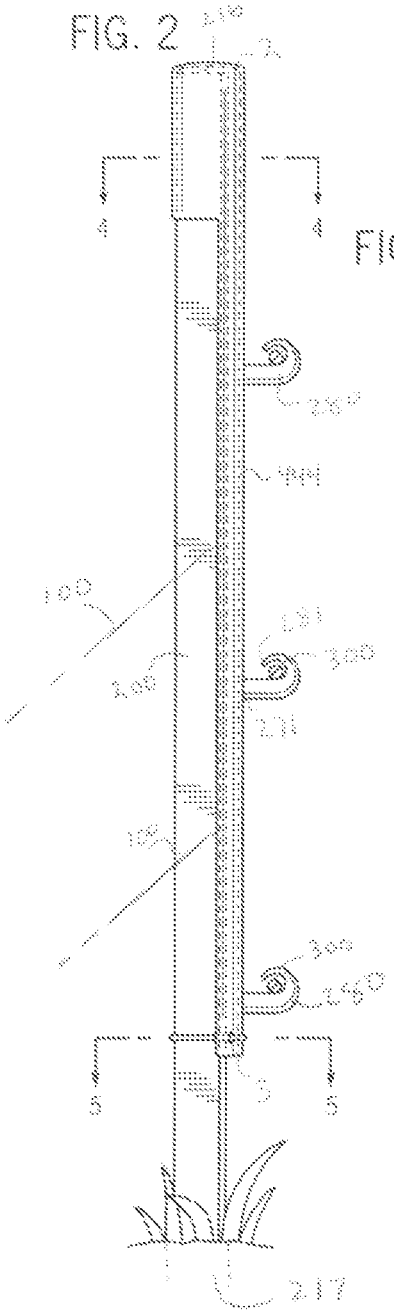
FIG. 2 illustrates a side plan view of the electric fence converter positioned on an existing fence post.

Referring now to FIG. 4 (a cross section of line 4-4 of FIG. 2), the exterior perimeter 11 at and near the top 2 of the device 1 may be tear-shaped; having a bulge portion 203. The tear-shaped top 2 of the device 1 may allow a standard t-shaped fence post 200 to fit within the interior 4 of the device 1. More specifically, an elongated arm 201 of the standard t-shaped fence post 200 may fit snugly within the tear-shaped bulge portion 203 of the inner wall 12 of the device 1 while the smaller arms 202, 203 of the t-shaped fence post 200 rest snugly against the opposite inner wall 12 of the device 1 while the device 1 is inserted over the t-shaped fence post 200 during use.

Figure 3:
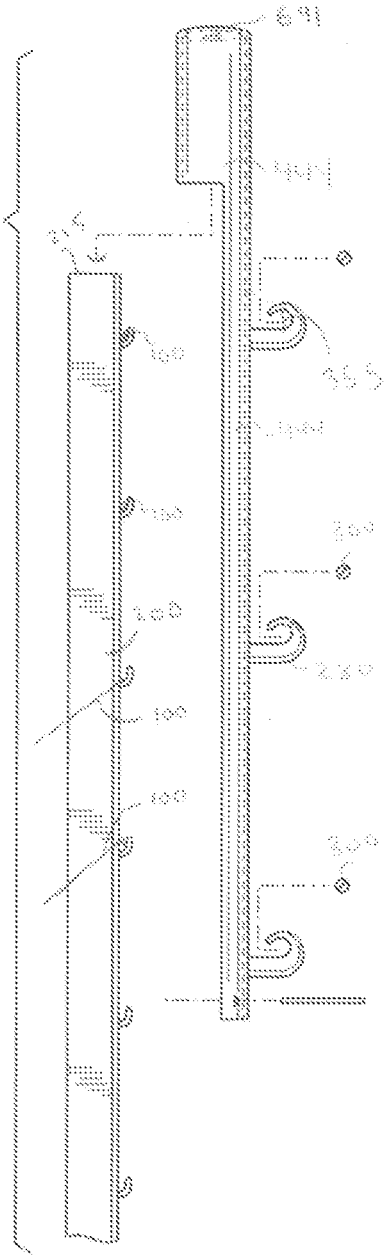
FIG. 3 illustrates a side plan view of the electric fence converter being inserted on an existing fence post.

The t-shaped fence post 200 may have a top side 215 which may contact the underside 216 (FIG. 2) of the top side 2 of the device 1 while the device 1 is in use. More specifically, the top side 215 of the t-shaped fence post 200 may support the device 1 while the device 1 is in use. In an embodiment, an adhesive 691 (FIG. 3) may be added to the underside 216 of the device 1 to further secure the device 1 to the fence post 200.

As stated above, the device 1 is suitable for insertion over a fence post 200. The fence post 200 may have a top side 215 and a bottom side 217 wherein the bottom side 217 is secured into the ground. Further, the fence post 200 may have a diameter 70 (in the cylindrical version of the fence posts 200 in FIGS. 6 and 7).

To convert a standard non-electrical fence into an electric fence, a user may insert the device 1 over the existing non-electric fence post 200 already secured into the ground. More specifically, the user may raise the device 1 into a position substantially over the fence post 200 and then lower the device 1 over the fence post 200 such that the bottom side 3 of the device 1 first slides over the top side 215 of the fence post 200. The cut-out portion 20 of the device 1 may allow the device 1 to slide down the fence post 200 while a non-electric horizontal wire 100 remains connecting a first fence post 200 to a second fence post 200. Therefore, the existing non-electric fence does not need to be disturbed.

The interior 4 (at the top 2) of the device 1 may be hollow such that the top 215 of the fence post 200 may fit snugly within the top 2 of the device 1. When resting in place, the device 1 may remain secured over the fence post 200 by, for example, gravity.

Figure 5:
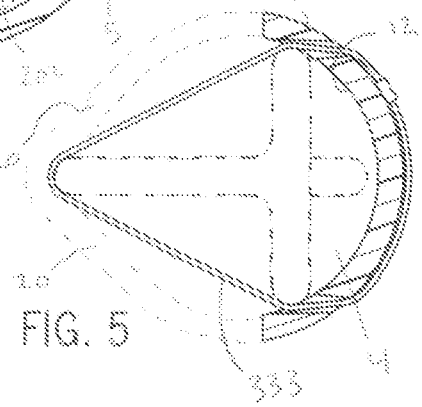
FIG. 5 illustrates a bottom cross view (Line 5-5) of the electric fence converter inserted over a standard t-shaped fence post.

Viewing the device 1 in a cross section (FIGS. 5 and 7), the cut-out portion 20 of the device 1 may cover approximately thirty to sixty percent of the exterior perimeter 11 of the device 1. As a result, cut-out portion 20 may allow, for example, a one hundred and eighty degree connection between the horizontal wire 100, the fence post 200, and another horizontal wire 100 connection. The dotted line along the exterior perimeter 11 of FIG. 5 illustrates the cut-out portion 20 in relation to the external surface 5.

Located on the exterior 5 of the device 1 may be a plurality of securing hooks 280. More specifically, the plurality of securing hooks 280 may be located on, for example, the exterior surface 5 of the device 1 (opposite the cut-out portion 20 of the device 1). The illustrations show three securing hooks 280 per electric fence converter 1, although any number of securing hooks 280 may be used on a single device 1 depending on the desired use and function. The plurality or securing hooks 280 may extend vertically along the length 10 of the device 1 such that the securing hooks 280 are substantially located directly above one another.

Figure 6:
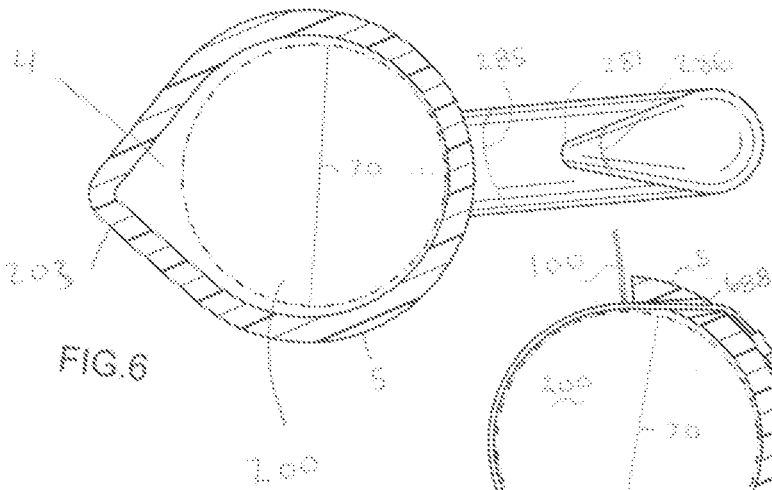
FIG. 6 illustrates a top cross view of the electric fence converter inserted over a standard cylindrical fence post.
Figure 7:
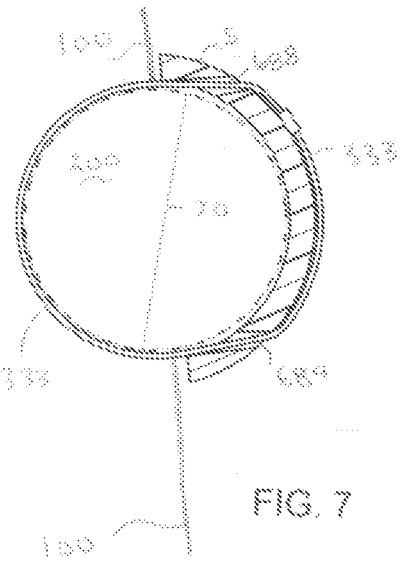
FIG. 7 illustrates a bottom cross view of the electric fence converter inserted over a standard cylindrical fence post.

The plurality of securing hooks 280 may have a first end 271, a distal end 281 and a circumference (FIG. 6). The first end 271 may be permanently attached to the main body 444 of the electric fence converter 1 whereas the distal end 281 may extend away from the main body 444 of the electric fence converter 1. More specifically, the first end 271 may be secured to the exterior 5 of the device 1 by, for example, glue, screws, soldering or any other suitable means. A circumference 285 of the securing hooks 280 at/near the first end 271 may be greater than a circumference 286 at/near the distal end 281 of the securing hook 280 such that the securing hook 280 becomes more narrow as it extends outward away from the main body 444 of the device 1. As a result of the greater circumference 285 at the first end 271, the securing hook 280 may allow greater stability of the securing hook 280 and may allow the securing hook 280 to resist bending and/or breaking free of the main body 444 of the electric fence converter 1.

When a user places a first device 1 over a first fence post 200 and a second device over a second fence post 200 (FIG. 1), the plurality of securing hooks 280 of the plurality of devices 1 may substantially line up with one another. More specifically, the distance from the ground 255 to (for example) the top securing hook 280 on the first device 1 should be approximately equal to the distance between the ground 255 to the top securing hook 280 of the second device 1 (when the ground is level). The user may then secure an electrical wire 300 along the fence. More specifically, the user may secure the electrical wire 300 onto each device 1 by securing the electrical wire 300 onto the securing hooks 280 of the device 1. The user may elect to secure a single electrical wire 300 on, for example, the middle of the three securing hooks 280 located on a single device 1, or the user may elect to secure a plurality of electrical wires 300 a plurality of the securing hooks 280 on the same device 1.

The electrical wire 300 may rest upon and be secured on the securing hooks 280 by, for example gravity. Alternatively, the electrical wire 300 may be tied or otherwise wrapped around the circumference of the securing hooks 280 to prevent the electrical wire 300 from inadvertently falling off the securing hooks 280. Further, because the plurality of securing hooks 280 may be located at a distance 612 (FIG. 1) from the ground 255 different then a distance 613 from the ground 255 of the existing non-electric wires 100 of the fence posts 200, the resulting fence (with the electric wires 300 and non-electric wires 100 both attached) will have an increased amount of total horizontal wires at various locations therein further providing security to the interior of the perimeter of the fence.

The plurality of securing hooks 280 may extend largely perpendicularly out from the main body 444 of the device 1. The plurality of securing hooks 280 may curve upward and back toward the main body 444 of the device 1. An opening 355 (FIG. 3) may remain wherein the distal end 281 of the plurality of securing hooks 280 does not completely curve back to and contact the body of the hook 280 therein creating a fully closed loop. The opening 355 may allow the user to slide and/or tie the electrical wire 300 through the opening 355 so as the electrical wire 300 may be secured to the device 1.

In a method of use, the bottom side 3 of the device 1 does not touch the ground 255 when inserted over the post 200 while in use. As a result, no force is needed to push the bottom 3 of the device 1 into the ground 255. Instead, the device 1 simply rests on the top side 215 of the post 200 by, for example, gravity. In an alternative method of use, a portion of the bottom side 3 of the device 1 may be forced into the ground 255, while the device 1 is inserted on the post 200. In this method, the device 1 is secured onto the post 200 by gravity and also by being secured into the ground 255. In this method of use, the device 1 is not easily moved by, for example, wind or other weather or unauthorized removal by vandals. Further, the length 10 of the device 1 may be altered such that the bottom side 3 may be long enough to reach from the top side 215 of the post 200 into the ground 255 or may be shorter such that the device 1 simply rests on the posts 200.

Figure 9:
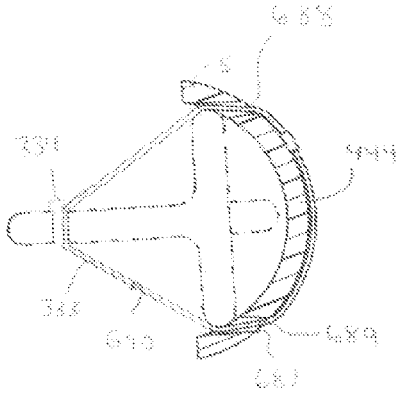
FIG. 9 illustrates a bottom cross section of the electric fence converter with a securing wire passing through a portion of a t-shaped fence post.

Referring now to FIGS. 8 and 9, a first opening 687 and a second opening 688 may be present on the main body 444 of the electric fence converter 1. More specifically, the first opening 687 and the second opening 688 may be located near the bottom side 3 of the electric fence converter 1. The first opening 687 and second opening 688 may each create a hole extending from the exterior surface 5 toward the interior wall 12 of the electric fence converter 1. It should be noted that the inner wall 12 of the middle and bottom 3 of the electric fence converter 1 remain exposed and are not concealed.

The first opening 687 and the second opening 688 may be located substantially at equal heights with respect to the bottom side 3 of the device 1. The first opening 687 and second opening 688 may have a diameter 689 which is slightly greater and a diameter 690 of a securing wire 333 which may pass through the first and second opening 678, 688. More specifically, the securing wire 333 may pass through the first opening 678, bend around the fence post 200 and may then pass through the second opening 688 (heading in the opposite direction). The two ends of the securing wire 333 may then be tied together or otherwise secured. As a result, the electric fence converter 1 may be secured to the fence posts 200 and may be less likely to be accidentally or intentionally removed from the fence posts 200.

In an embodiment, the securing wire 333 may not only pass through the first opening 687 and second opening 688, but may also pass through an opening 334 in the fence post 200 to further secure the device 1 to the existing fence post 200 (FIG. 9) and prevent movement of the device 1 up or down with respect to the fence post 200.

As stated above, as a result of the present device 1 and method, a user does not need to remove an existing fence and replace the existing fence with a new electric fence. Instead, the user may use the existing fence and posts 200 already secured within the ground 255. Further, the user does not need to remove the existing non-electric wire 100 located on the existing fence.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

I claim:

1. An electric fence converter comprising:

an elongated body having a cylindrical shape and having a closed top cap portion having a longitudinally-extending cylindrical sidewall with an arcuate cross-sectional shape;

an open bottom of the top cap;

an exterior surface, a length and a generally hollow interior portion wherein the generally hollow interior portion receives a portion of a fence post which is already secured into the ground;

a cut-out portion defining an integrally-formed elongated arcuate body portion, longitudinally-extending downwardly from the cylindrical sidewall at the open bottom of the top cap portion and having the same arcuate cross-sectional shape as a partial circumference portion of the cylindrical sidewall;

wherein the cut-out portion allows the elongated body to be secured on a fence post while a wire secured to the fence post remains undisturbed;

a plurality of securing hooks located on and extending outwardly away from the exterior surface of the elongated body, the plurality of securing hooks being longitudinally spaced along the elongated arcuate body portion and wherein the plurality of securing hooks receive and secure an electrical wire; and wherein an underside of the closed top cap portion of the elongated body rests on a top of the fence post by gravity and a bottom of the elongated arcuate body portion is secured to the fence post adjacent the ground.

2. The electric fence converter of claim 1 wherein a horizontal cross section of the closed to cap portion of the elongated body is tear-shaped and wherein the tear-shaped cross section snugly fits a t-shaped fence post.

3. The electric fence converter of claim 1 further comprising:

an adhesive located between an underside of the closed top cap portion of the elongated body and the fence post wherein the adhesive secures the electric fence converter to the fence post.

4. The electric fence converter of claim 1 further comprising:

a plurality of openings located at a bottom of the elongated body wherein a securing wire passes through the plurality of openings of the bottom of the elongated body and wherein the securing wire passes at least partially around the fence post and wherein the securing wire secures the electric fence converter to the fence post.

5. The electric fence converter of claim 4 wherein the securing wire passes through an opening of the fence post as well as the plurality of openings of the bottom of the elongated body.

6. The electric fence converter of claim 1 wherein the bottom of the elongated body is secured within the ground.

7. The electric fence converter of claim 1 wherein the cut-out portion covers approximately thirty to sixty percent of the cross-section of the exterior surface of the elongated body such that a wire connecting a first fence post to a second fence post is not disturbed when the electric fence converter is placed over the first or second fence post.

8. The electric fence converter of claim 1 wherein the cut-out portion has a length which covers approximately seventy to ninety percent of the length of the elongated body.

9. The electric fence converter of claim 1 wherein each of the plurality of securing hooks is located vertically along the length of the elongated body and wherein each of the securing hooks is located directly above each other.

10. The electric fence converter of claim 1 further comprising:

a first end of each of the securing hooks wherein the first end has a cross-sectional circumference;

a second end of each of the securing hooks wherein the second end has a cross-sectional circumference;

wherein the first end of the securing hook is secured to the elongated body; and wherein the circumference of the first end of the securing hook is greater than the circumference at the second end of the securing hook.

11. The electric fence converter of claim 10 wherein the first end of each of the plurality of securing hooks extends outward from the elongated body in approximately a perpendicular manner.

12. The electric fence converter of claim 10 wherein the second end of the securing hooks curves back toward the elongated body.

* * * * *